United States Patent [19]

Mellgren

[11] 3,990,334

[45] Nov. 9, 1976

[54] METHOD AND SAW BLADE FOR THE SAWING OF PARTICULARLY WOOD

[75] Inventor: Sven Arne Mellgren, Taby, Sweden

[73] Assignee: Sikob Svensk Industria Konstructionsoch Berakningskontor AB, Solna, Sweden

[22] Filed: Sept. 17, 1974

[21] Appl. No.: 506,903

[30] Foreign Application Priority Data

Sept. 18, 1973 Sweden ..... 7311922

[52] U.S. Cl. ..... 83/56; 83/661; 83/837; 83/854; 83/663; 83/835

[51] Int. Cl.[2] ..... B27B 33/08; B27B 33/02

[58] Field of Search ..... 83/661, 835, 837, 846, 83/854, 855, 663, 13, 56

[56] References Cited

UNITED STATES PATENTS 3,132,677 5/1964 Dunn ..... 83/661

*Primary Examiner*—Donald R. Schran

*Attorney, Agent, or Firm*—Haseltine, Lake & Waters

[57] ABSTRACT

A method of sawing a wooden workpiece makes simultaneous use of a chip cutting operation with chip cutting saw teeth provided along the leading edge of a saw blade and a cutting operation with knife edges provided on the same leading edge of the saw blade. Between each pair of adjacent chip cutting saw teeth on the leading edge of the saw blade a knife edge, also provided on the leading edge of the saw blade, is fed into the workpiece together with the saw teeth in a plane located within the kerf made by the saw teeth and in such a position relative to the saw teeth that this knife edge cuts into the workpiece or at least into the chip, which still adheres to the workpiece and is being formed by the one saw tooth, and cuts this chip into two portions, which when liberated from the workpiece under the action of the saw tooth are distributed on opposite sides of the saw blade into the clearances between the side surfaces of the saw blade and the wall of the kerf.

16 Claims, 6 Drawing Figures

METHOD AND SAW BLADE FOR THE SAWING OF PARTICULARLY WOOD

The present invention concerns a method of sawing a workpiece, especially of wood, by simultaneous use of a chip removing operation with chip cutting saw teeth provided on a saw blade and a cutting operation with knife edges on the same saw blade. The invention concerns also a saw blade for practising the sawing method according to the invention.

A saw blade has a leading edge, which may be straight as for instance on band saw blades and frame saw blades or curved as on circular saw blades and along which chip removing saw teeth are provided regularly spaced. Between each pair of adjacent teeth the leading edge of the saw blade is normally concavely curved so as to form a pocket or gullet of smaller or larger depth, which has as its object to collect the saw dust and convey and discharge it from the kerf made in the workpiece. The demand for ever increasing production rates in sawing operations has made it necessary to increase the size and depth of the gullets between the saw teeth, which reduces the mechanical strength of the teeth. This reduced strength of the teeth has been compensated by increasing the thickness of the saw blade, which results, however, in a wider kerf and an increased loss of material at the sawing operation. If the gullets between the teeth of a saw blade are of an insufficient size to collect the whole volume of saw dust being produced, the saw dust will be forced into the kerf on both sides of the saw blade, which has a smaller thickness than the width of the kerf, as the points of the teeth are generally swaged or set. This results easily in a characteristic oscillating lateral movement of the saw blade in the kerf, which lateral oscillation produces an unacceptable sawing surface and which is probably due to a tendency of the saw dust to pack alternately on the one side and the other side of the saw blade in an inconsistent and random manner.

In order to eliminate this problem it has been suggested in the prior art, for instance in the German patent specification 1,503,997 and the American Pat. No. specification 3,262,475, to sharpen or chamfer the deepest portion or bottom of each gullet of a saw blade, the object of this chamfered or sharpened portion of each gullet being to guide and distribute the saw dust or chips being cut by the saw teeth from the gullet onto both sides of the saw blade into the clearances between the side surfaces of the saw blade and the walls of the kerf. A large portion of the saw dust should consequently in this case be collected and conveyed in the clearances between the side surfaces of the saw blade and the walls of the kerf, which has a larger width than the thickness of the saw blade. However, it is not possible in this way to obtain a safe, uniform and consistent distribution of the saw dust on both sides of the saw blade, wherefore the tendency to an oscillating lateral movement of the saw blade in the kerf remains. This tendency is augmented by the fact that for a saw blade of this type the thickness of the blade must be considerably smaller than the width of the kerf, which causes a correspondingly inferior lateral guidance of the saw blade in the kerf.

The primary object of the present invention is therefore to provide an improved method of sawing a workpiece, especially of wood, and a corresponding saw blade, which eliminates or substantially reduces the disadvantages discussed above and at the same time makes it possible to reduce the thickness of the saw blade and increase the mechanical strength of the teeth.

The method according to the invention is based on a simultaneous use of a chip cutting operation with chip removing saw teeth provided on a saw blade and a cutting operation with knife edges provided on the same saw blade and is primarily characterized in that between each pair of adjacent saw teeth a knife edge is fed into the workpiece together with the teeth in a plane located within the kerf and in such a position relative to the teeth that the knife edge cuts into at least the chip just liberated from the workpiece by one of said pair of saw teeth and preferably also into the chip, which still adheres to the workpiece and is being formed by the saw tooth, and cuts these chips into two portions, which are distributed on opposite sides of the saw blade by the knife edge.

Consequently, the invention does not make use of any gullets in the rear sense or any other recesses, openings, holes or similar arrangements in the saw blade for collecting and conveying the chips removed from the workpiece, but this chips are fed directly and at the rate they are separated from the workpiece into the clearances on both sides of the saw blade between the side surfaces of the saw blade and the walls of the kerf. Therefore, the size of gullets in the saw blade constitutes no longer a limiting factor for the production rate, and the teeth can be made shorter and thus obtain a larger mechanical strength without any increase in their thickness. The reduced thickness of the saw teeth results in a narrower kerf and thus in a reduced loss of material at the sawing operation. It follows also that the amount of saw dust is reduced correspondingly, which also combines to facilitate the transport and discharge of the saw dust from the kerf even at high production rates.

Further, in the method according to the invention the knife edges on the leading edge of the saw blade are preferably permanently engaging and projecting into a portion of the workpiece, viz. at least the chips which still adhere to the workpiece and are being formed by the saw teeth and possibly also a portion of the workpiece which is still completely unaffected by the saw teeth, which gives a very efficient lateral guidance of the saw blade in the kerf.

The knife edges on the leading edge of the saw blade can be located in front of the points of the saw teeth as seen in the feeding direction of the saw blade or alternatively the knife edges may be located behind the points of the saw teeth as seen in the feeding direction of the saw blade, in which latter case the distance from the points of the saw teeth to the knife edges does not exceed substantially the feeding per tooth of the saw blade.

The "feeding" of the saw blade means in this connection the relative movement between the workpiece and the saw blade in the direction perpendicular to the leading edge of the saw blade, and the "feeding per tooth" means the magnitude of this feeding movement during the time interval necessary for a tooth on the saw blade to move in the direction of the leading edge of the saw blade over a distance equal to the spacing between two adjacent teeth. Consequently, the "feeding per tooth" corresponds to the cutting depth of each tooth in the workpiece.

In the following the invention and additional characteristic features thereof will be described more in detail with reference to the accompanying drawings, which illustrate by way of example some embodiments of the invention. In the drawings FIG. 1 is a partial side view of a stright saw blade, for instance a band saw blade or a frame saw blade, embodying the invention and illustrates schematically the manner in which the saw blade produces a kerf in a workpiece;

Figure 1:
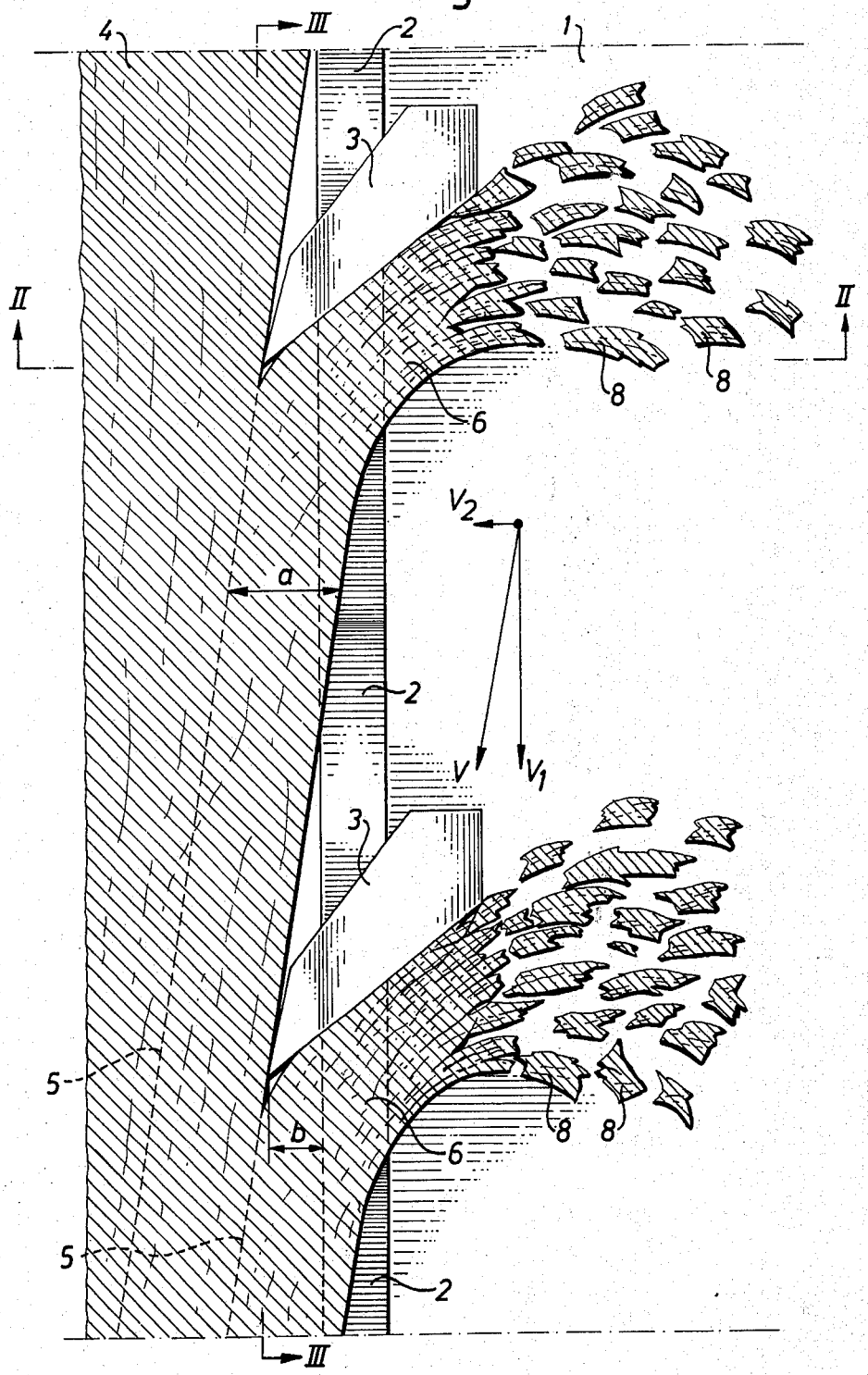
Figure 2:
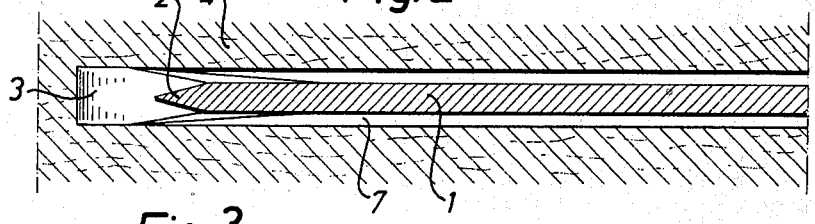
FIG. 2 is a partial section view along the line II—II in FIG. 1.
Figure 3:
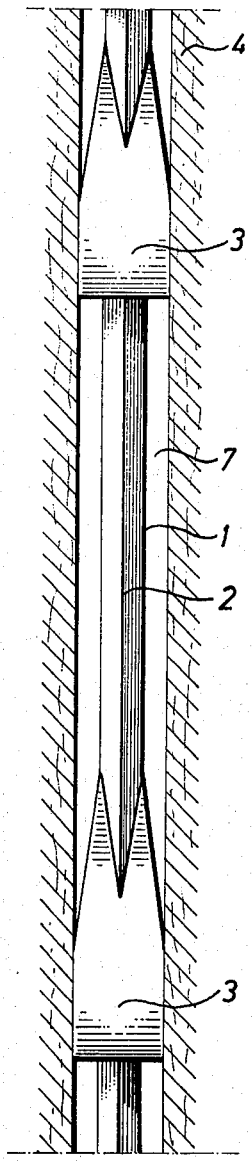
FIG. 3 is a partial front view of the leading edge of the saw blade as seen along the line III—III in FIG. 1.

FIGS. 1 to 3 show schematically and by way of example a straight saw blade according to the invention, for instance a band saw blade or a frame saw blade, generally designated with 1. The leading edge of the saw blade is shaped as a sharp knife or cutting edge 2 and is provided with chip removing or chip cutting saw teeth 3, which are attached to the leading edge of the saw blade in a convenient way, for instance by welding or brazing, so as to project in front of the knife edge 2 and extend rearwards with one shank on each side of the leading edge of the saw blade. The saw blade 1 is illustrated schematically while sawing a kerf in a workpiece 4. The movement of the saw blade 1 relative to the workpiece 4 is indicated in FIG. 1 with an arrow V and the points of the saw teeth 3 move consequently along the dotted lines 5 in the workpiece 4 during the sawing operation. The movement V of the saw blade 1 relative to the workpiece 4 can be split up in a component $V_1$ in the longitudinal direction of the saw blade, that is parallel to the leading edge of the saw blade, and the feeding movement $V_2$ perpendicular to the leading edge of the saw blade. The magnitude of the feeding movement $V_2$ of the saw blade 1 per tooth, that is the so called "feeding per tooth" or "cutting depth per tooth," is obviously equal to the distance *a* indicated in FIG. 1.

The distance between the points of the chip cutting saw teeth 3 and the knife edges 2, as measured in the feeding direction of the saw blade 1, that is the distance *b* indicated in FIG. 1, is smaller than the feeding *a* per tooth. As a result hereof the knife edges 2 between adjacent teeth 3 cut into at least the chips 6 which still adhere to the workpiece 4 and which are being formed from the workpiece by the saw teeth 3. If the distance *b* between the points of the saw teeth and the knife edges 2 is sufficiently small, the knife edges 2 may even cut into a portion of the material of the workpiece 4 which is still completely unaffected by the saw teeth 3. In any case it is obvious that the knife edges 2 between the saw teeth 3 cut the chips 6 still adhering to the workpiece 4 and being formed by the saw teeth 3 into two portions on opposite sides of the saw blade 1. Consequently, the division of the chips and their distribution on both sides of the saw blade 1 into the clearances between the side surfaces of the saw blade and the walls of the kerf 7 (compare FIGS. 2 and 3) takes place already while the chips are still being formed or cut by the saw teeth 3. When the chips 6 are eventually liberated from the workpiece 4 and then generally break up into smaller pieces or portions 8, as schematically indicated in FIG. 1, into what is generally called saw dust, the distribution of this saw dust on both sides of the saw blade 1 has already taken place in a well-defined way.

Consequently, a saw blade according to the invention does not have to be provided with any gullets in the real sense or any other recesses, holes or openings in the saw blade for collecting and conveying the saw dust. It is also appreciated that the invention provides a very welldefined uniform and consistent distribution of the saw dust on both sides of the saw blade. It is also obvious that the knife edges 2, which are permanently projecting into the workpiece 4 to a smaller or lesser extent, provide a very efficient lateral guidance of the saw blade 1 in the kerf 7.

In the embodiment of a saw blade according to the invention illustrated in FIGS. 1 to 3 and described above the knife edges 2 are located in the centre plane of the saw blade 1, which seems to be preferable, but it is realized that the knife edges could also be located in a plane separate from the centre plane of the saw blade. Further, in FIGS. 1 to 3 the invention has been illustrated in connection with a straight saw blade, as for instance a band saw blade or a frame saw blade, but it is appreciated that the invention can be applied with the same advantages also to a circular saw blade, in which case the knife edges between the saw teeth will be arcs of a circle having its center of curvature substantially coinciding with the centre of rotation of the saw blade.

Figure 5:
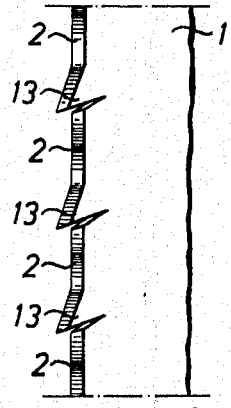
FIG. 5 is a schematic partial side view of a saw blade according to still another embodiment of the invention.
Figure 6:
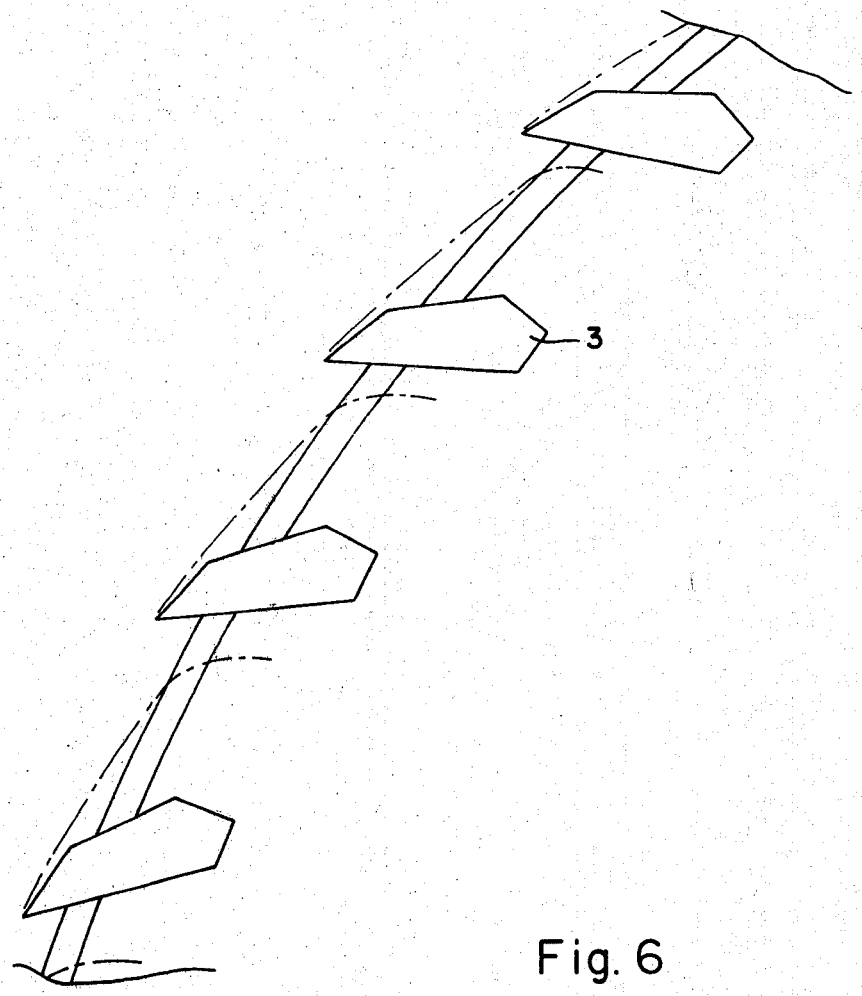
FIG. 6 is a partial schematic view of a circular saw blade in which the knife edge is an arc of a circle having its center of curvature substantially coinciding with the center of rotation of the saw blade.

Further, the saw teeth can of course be of a different design or shape than that illustrated by way of example in FIGS. 1 to 3. Thus, the saw teeth may for instance be provided in the manner illustrated schematically in FIG. 5 by punching tabs 13 in the saw blade and bending and setting and possibly stretching these tabs alternatingly on opposite sides from the saw blade.

In the saw blades according to the invention illustrated by way of example in FIGS. 1 to 3 and FIG. 5 respectively the saw teeth project with their points in front of the knife edges, but according to an alternative embodiment of the invention the saw teeth may instead be arranged with their points located somewhat at the rear of the knife edges so that the knife edges cut into the workpiece before the chip removing saw teeth engage the workpiece. Thus, in the embodiment of the invention illustrated in FIGS. 1 to 3 the teeth 3 could for example be made in two halves welded or brazed onto the side surfaces of the saw blade 1 opposite to each other and somewhat rearwards of the knife edge 2 so that the points of the teeth are located a short distance rearwards of the knife edge 2.

Figure 4:
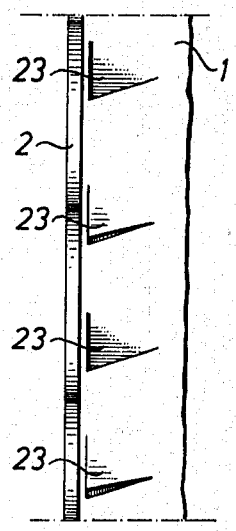
FIG. 4 is a schematic partial side view of a saw blade according to another embodiment of the invention.

A similar relative position of the knife edge on the leading edge of the saw blade and the chip cutting teeth can be obtained for instance in the manner schematically illustrated in FIG. 4 in that tabs 23 are punched in the saw blade 1 and bent and set and possibly stretched alternatingly in opposite directions from the saw blade.

As mentioned in the foregoing it is preferred that the knife edges are located behind the points of the saw teeth and spaced therefrom by a distance not exceeding the feeding per tooth of the saw blade, whereby the knife edges cut into the chips which still adheres to the workpiece and are being formed by the saw teeth. However, a satisfactory operation and result may be obtained also with a somewhat larger spacing between the knife edges and the points of the saw teeth, provided that the knife edges cut into and divide the strips just liberated from the workpiece, before these chips have had the time to move any substantial distance and to assume a random and uncontrolled attitude in the kerf.

What is claimed is:

1. A method of sawing a workpiece of wood, by a simultaneous chip cutting operation with chip cutting saw teeth on a saw blade and a cutting operation with knife edges on the same saw blade, the method comprising the steps of: feeding between each pair of adjacent saw teeth a knife edge together with the saw teeth into the workpiece in a plane located within the kerf cut by the saw teeth and in such a position relative to the saw teeth that the knife edge cuts into at least the chip just liberated from the workpiece by the one tooth of said pair of adjacent saw teeth and preferably also into the chip which still adheres to the workpiece and is being formed from the workpiece by said saw teeth, and cutting these chips into two portions distributed on opposite sides of the saw blade by the knife edge.

2. A method as claimed in claim 1, including the step of feeding said knife edge into the workpiece in a plane substantially coinciding with the center plane of the kerf.

3. A saw blade for sawing a workpiece of wood, comprising a leading edge shaped as a cutting knife edge and located in a plane parallel to the side surfaces of the blade; and chip cutting saw teeth along said knife edge.

4. A saw blade as claimed in claim 3, wherein said knife edge is located in front of the points of the saw teeth.

5. A saw blade as claimed in claim 3, which is a circular saw blade and in which said knife edge is an arc of a circle having its centre of curvature substantially coinciding with the centre of rotation of the saw blade.

6. A saw blade as claimed in claim 3, wherein the saw teeth are made by deforming portions of the saw blade, for instance by punching and bending tabs in the saw blade.

7. A saw blade as claimed in claim 3, wherein said knife edge is substantially straight.

8. A saw blade as claimed in claim 3, wherein the saw teeth are mounted on said leading edge, said leading edge being pre-shaped as a cutting knife edge.

9. A saw blade as claimed in claim 3, wherein said knife edge is located substantially in the center plane of the saw blade.

10. A method of sawing a workpiece of wood, by a simultaneous chip cutting operation with chip cutting saw teeth on a saw blade and a cutting operation with knife edges on the same saw blade, the method comprising the steps of: feeding between each pair of adjacent saw teeth a knife edge together with the saw teeth into the workpiece in a plane located within the kerf cut by the saw teeth and in a position behind the points of the saw teeth, as seen in the feeding direction of the saw blade, and at a distance from the points of the saw teeth not substantially exceeding the magnitude of the feeding per tooth of the saw blade, so that the knife edge cuts into at least the chip just liberated from the workpiece by the one tooth of said pair of adjacent saw teeth and preferably also into the chip which still adheres to the workpiece and is being formed from the workpiece by said saw tooth, and cuts these chips into two portions being distributed on opposite sides of the saw blade by the knife edge.

11. A saw blade for sawing a workpiece of wood, comprising a leading edge shaped as a cutting knife edge and located in a plane parallel to the side surfaces of the blade; and chip cutting saw teeth along said knife, the points of said saw teeth projecting in front of said knife edge by a distance not substantially exceeding the intended magnitude of the feeding per tooth of the saw blade during a sawing operation.

12. A method as claimed in claim 10 including the step of feeding said knife edge into the workpiece in a plane substantially coinciding with the center plane of the kerf.

13. A saw blade as claimed in claim 11 wherein said knife edge is substantially straight.

14. A saw blade as claimed in claim 11 wherein the saw teeth are mounted on said leading edge, said leading edge being pre-shaped as a cutting knife edge.

15. A saw blade as claimed in claim 11 wherein said knife edge is located substantially in the center plane of the saw blade.

16. A saw blade as claimed in claim 11 comprising a circular saw blade, said knife edge being an arc of a circle having its center of curvature substantially coinciding with the center of rotation of the saw blade.

* * * * *